United States Patent [19]

Asari et al.

[11] Patent Number: 4,696,176

[45] Date of Patent: Sep. 29, 1987

[54] PULLBACK TYPE DOUBLE-ACTING INDIRECT EXTRUSION PRESS

[75] Inventors: Akira Asari, Osaka; Takahisa Tabuchi, Kobe, both of Japan

[73] Assignee: Kabushiki Kaisha Kobe Seiko Sho, Kobe, Japan

[21] Appl. No.: 824,582

[22] Filed: Jan. 23, 1986

[51] Int. Cl.[4] ..... B21C 23/21; B21C 35/04

[52] U.S. Cl. ..... 72/273.5; 72/265

[58] Field of Search ..... 72/253.1, 254, 265, 72/266, 270, 273.5

[56] References Cited

U.S. PATENT DOCUMENTS

| | | | |
|---|---|---|---|
| 4,230,661 | 10/1980 | Asari et al. | 264/323 |
| 4,345,450 | 7/1982 | Doudet | 72/273.5 |
| 4,365,497 | 12/1982 | Asari | 72/273.5 |
| 4,379,398 | 4/1983 | Asari et al. | 72/273.5 |
| 4,399,676 | 8/1983 | Tatsuhiko et al. | 72/273.5 |
| 4,522,052 | 6/1985 | Doudet | 72/265 |

FOREIGN PATENT DOCUMENTS

| | | | |
|---|---|---|---|
| 1452320 | 1/1969 | Fed. Rep. of Germany . | |
| 3117109 | 4/1982 | Fed. Rep. of Germany . | |
| 59-2887 | 1/1984 | Japan | 72/273.5 |
| 370274 | 4/1932 | United Kingdom | 72/273.5 |
| 894737 | 4/1962 | United Kingdom | 72/273.5 |

*Primary Examiner*—Lowell A. Larson

*Attorney, Agent, or Firm*—Oblon, Fisher, Spivak, McClelland & Maier

[57] ABSTRACT

A pullback type indirect extrusion press capable of extruding a tubular article, the press including first and second movable platens connected to each other by columns, the movable platens being arranged in front of and behind a fixed platen, a mechanism for producing a extruding force provided above and below or the left and right between the fixed platen and the first movable platen, and a container device and a die stem arranged between the fixed platen and the second movable platen. A piercing cylinder mechanism is provided on the axis of the press on the side of the non-extrusion zone, the piercing cylinder mechanism being provided independently of the mechanism for producing the extruding force.

3 Claims, 25 Drawing Figures

PULLBACK TYPE DOUBLE-ACTING INDIRECT EXTRUSION PRESS

BACKGROUND OF THE INVENTION

1. Field of the Invention

The present invention relates to a pullback type indirect extrusion press, and more specifically to a pullback type double-acting indirect extrusion press to make it possible to extrude tubular articles.

2. Description of the Prior Art

The indirect extrusion press of the pullback type, for example, as disclosed in Japanese Utility Model Publication No. 2887/84 has a billet scalper provided on the center axis of extrusion of a fixed platen and one movable platen. The aforementioned extrusion press is useful for its intended purpose but is not able to extrude tubular articles.

SUMMARY OF THE INVENTION

Differing from a conventional pullback type indirect extrusion press which merely has an image of a single-acting exclusive use machine, the present invention provides a pullback type double-acting indirect extrusion press which is able to extrude tubular products having high quality and high accuracy and of which maintenance is easily accomplished under the simplified construction.

According to one aspect of the present invention, there is provided a pullback type indirect extrusion press comprising movable platens connected to each other by columns, the movable platens being arranged before and behind a fixed platen, means for producing an extruding force provided above and below or to left and right between the first platen and one movable platen, and a container device and a die stem arranged between the fixed platen and the other movable platen, characterized in that a piercing cylinder mechanism is provided, independently of the means for producing the extruding force, through a reaction withstanding member on the axis of a press on the side of non-extrusion zone of the fixed platen, the piercing cylinder mechanism being provided with a mandrel in cooperation with a die hole of the die stem to determine a shape of a material to be extruded on the side of extruding direction, and a feed-liquid switching valve mechanism for reciprocatingly sliding the mandrel on the axis of the press. According to another aspect of the present invention, there is provided a pullback type double-acting extrusion press wherein the piercing cylinder mechanism is provided with a mandrel in cooperation with a die hole of a die stem to determine a shape of an extruding material on the side of extruding direction whilst being provided with a tail rod having an engaging portion on the side of non-extruding direction so that the mandrel may be reciprocatingly slid and locked on the press axis through a feed-liquid switching valve mechanism, and a mandrel stopper mechanism having a gate member disengageable with the engaging portion of the piercing mechanism and which is mounted on the fixed platen.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein:

FIG. 3 is a sectional view showing the step for supplying a billet;

FIG. 4 is a sectional view showing the step of inserting a billet;

FIG. 5 is a sectional view showing the step of upsetting;

FIG. 6 is a sectional view showing the step of piercing;

FIG. 7 is a sectional view showing the step of extrusion;

FIG. 8 is a sectional view showing the step of termination of extrusion;

FIG. 9 is a sectional view showing the state where a die is slidably moved;

FIG. 10 is a sectional view showing the step of ejecting refuse and the step of shearing;

FIG. 11 is a sectional view taken on line B—B of FIG. 10;

FIG. 12 is a sectional view of an initial position as indicated by the same arrow as that of FIG. 11;

DESCRIPTION OF THE PREFERRED EMBODIMENTS

Prior to explanation of the embodiments, operation of the present system will be first described.

Figure 3:
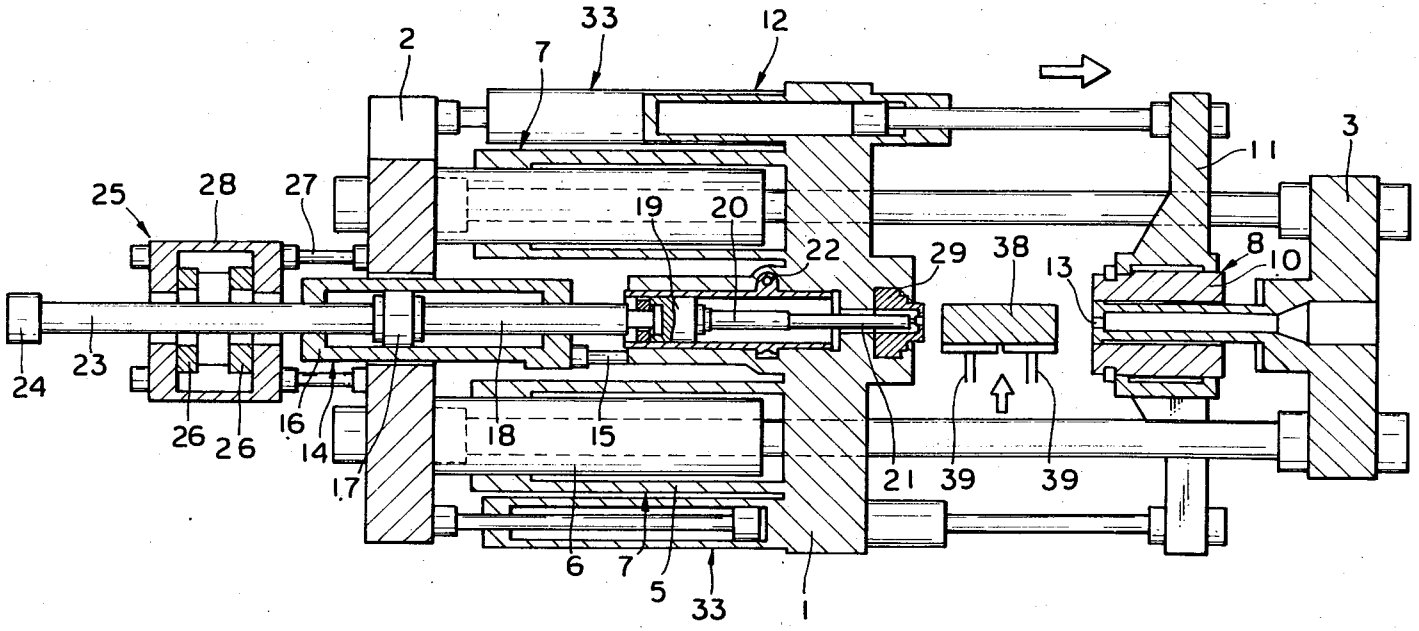
FIGS. 3 through 12 show one cycle of the press.
Figure 4:
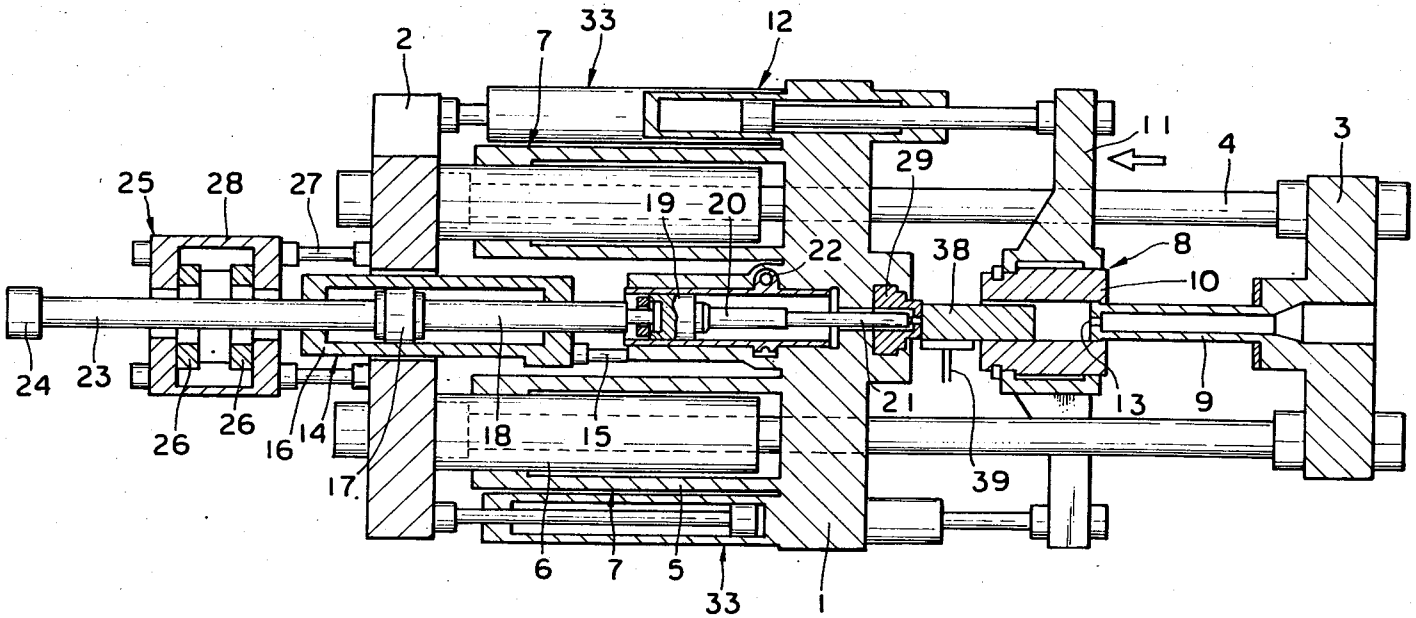
Figure 5:
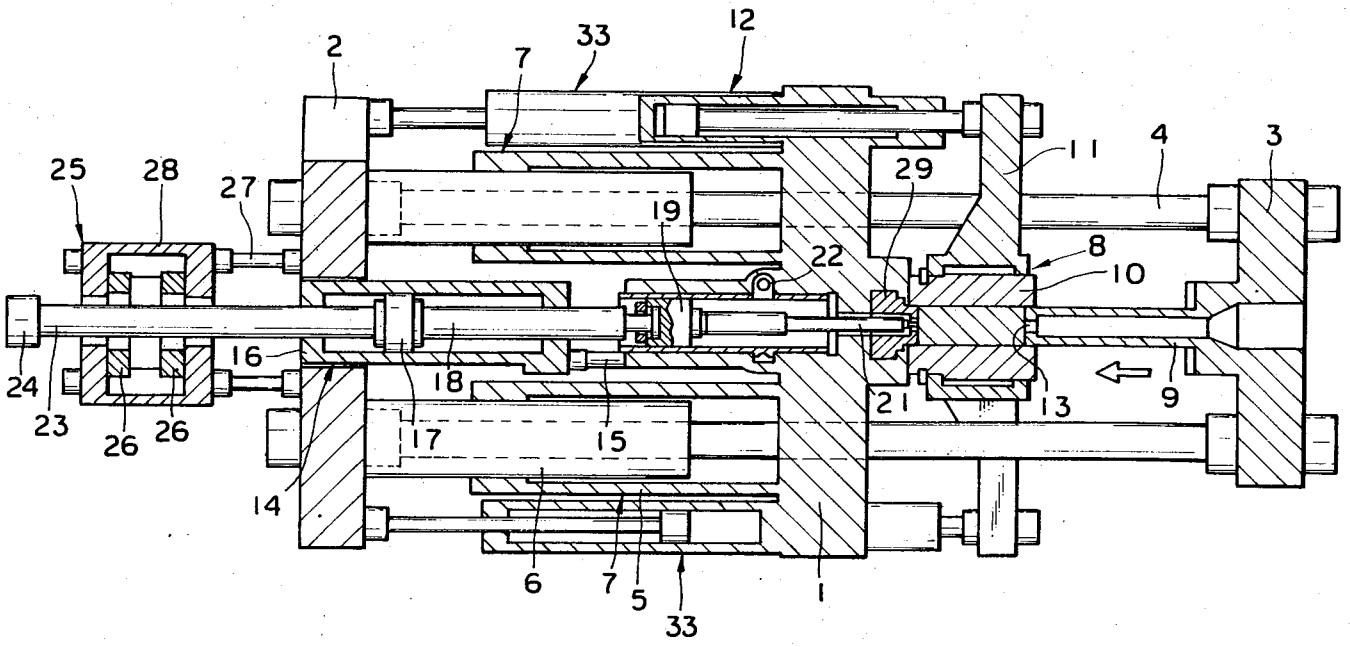

In FIG. 3, a container device is placed over a die stem 9, and in this condition, a billet 38 is carried onto the press axis through a billet loader 39, and thereafter, the container device is moved toward a fixed platen 1 as shown in FIG. 4, whereby the billet 38 is inserted into the billet chamber of a container 10. Then, the die stem 9 is moved in a non-loaded state as shown in FIG. 5 by means of a side cylinder mechanism 33 toward the fixed platen 1, whereby the billet 38 within the container 10 is upset.

Thereafter, pressure oil is supplied to a cylinder 16 of a piercing mechanism 14, whereby a mandrel 21 is moved in a piercing direction and the billet 38 within the container 10 is bored along its axis.

Figure 6:
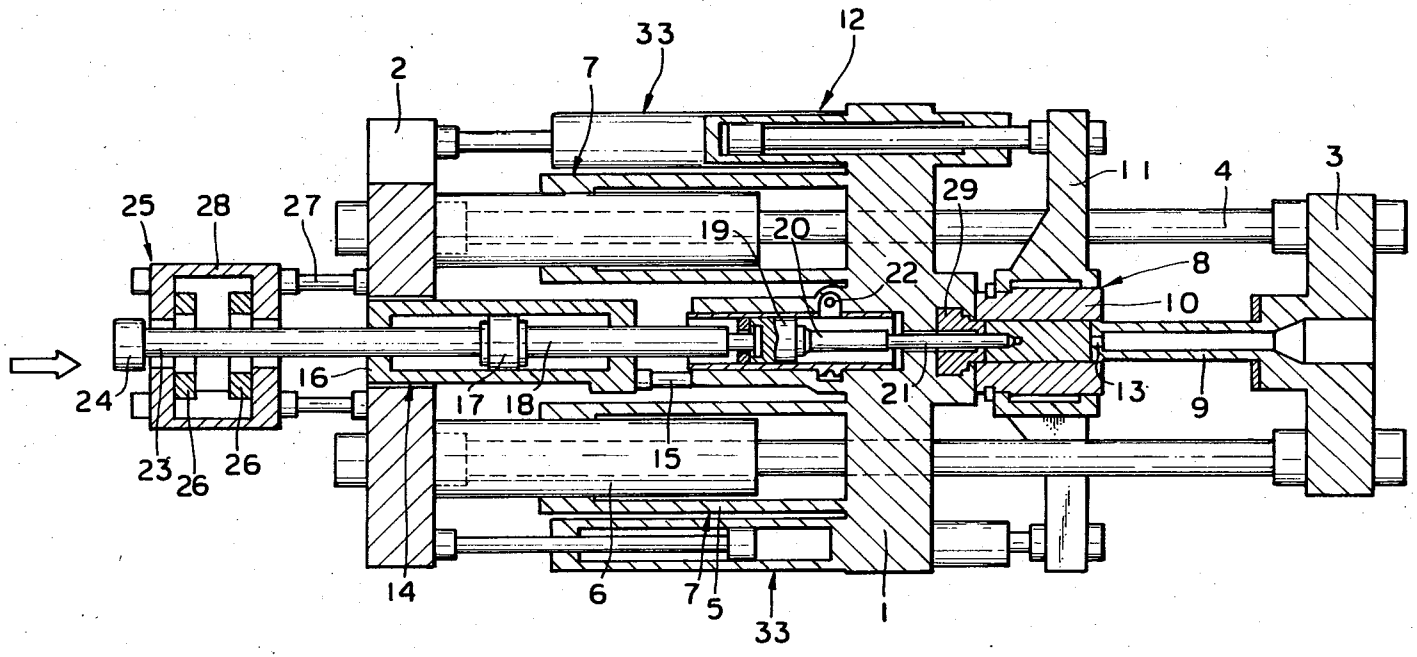
Figure 7:
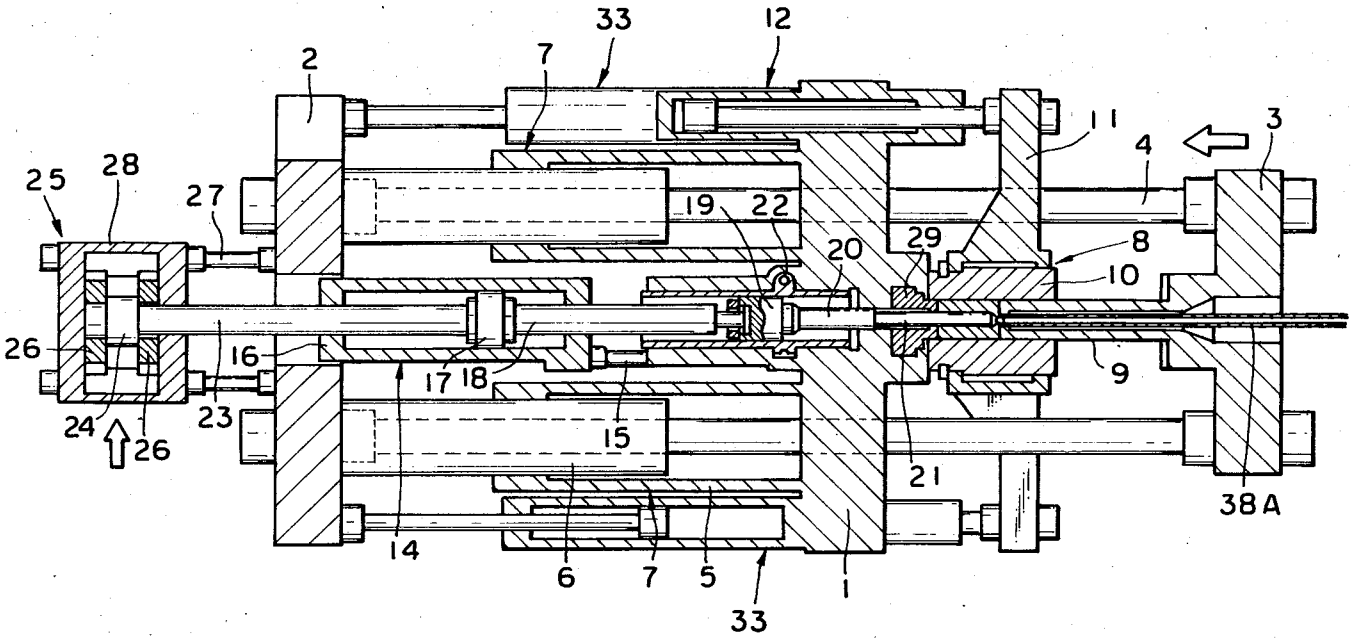

The piercing shown in FIG. 6 is carried out until the foremost end of the mandrel 21 faces a die hole 13 of the die stem 9. When the piercing has been completed, a pair of front and rear gate members 26 provided on a mandrel stopper mechanism 25 are brought into engagement with an engaging portion 24 provided on a tail rod 23 of the piercing mechanism 14 to restrict movement of the mandrel 21. As shown in FIG. 7, oil under pressure is supplied to a means for producing an extruding force 7 whereby during extrusion, indirect extrusion of a tubular product 38A is carried out in a state where a relative position between the foremost end of the mandrel 21 and the die hole 13 is maintained.

Figure 8:
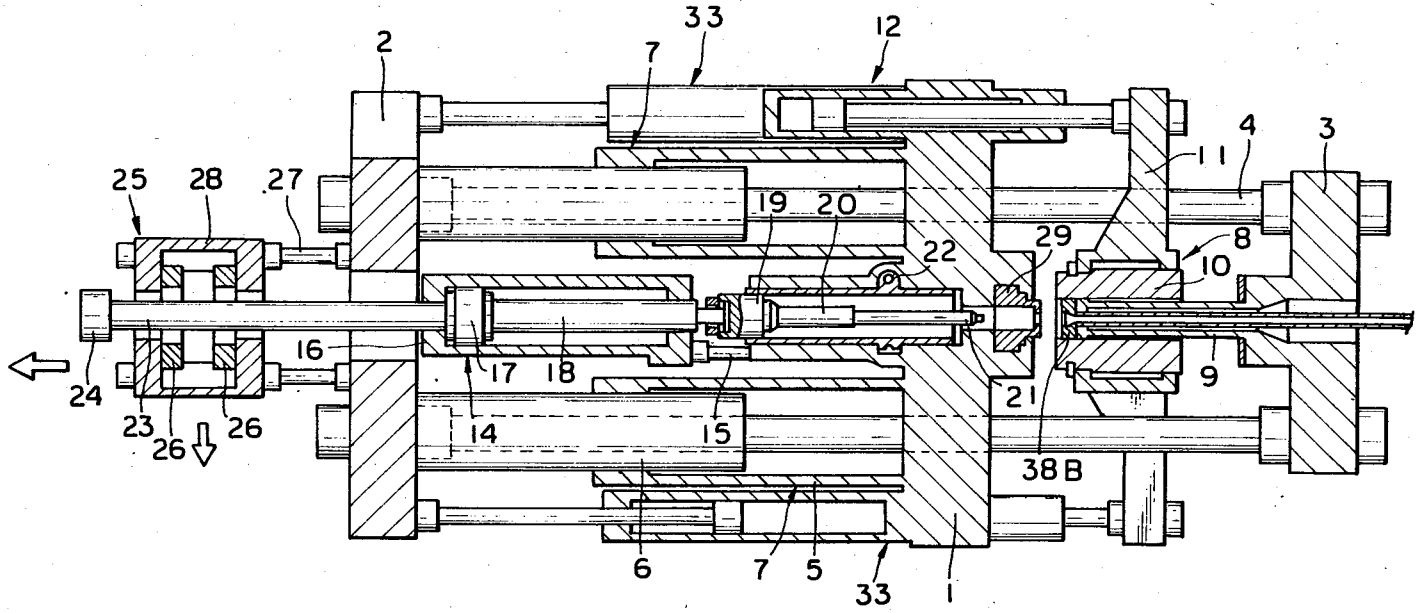

Upon termination of the extrusion, as shown in FIG. 8, a main ram 6 is moved backward to in turn slightly move backward the container device 8, and the gate members 26 of the mandrel stopper mechanism 25 are disengaged from the engaging portion 24 to move the mandrel 21 backward.

Figure 9:
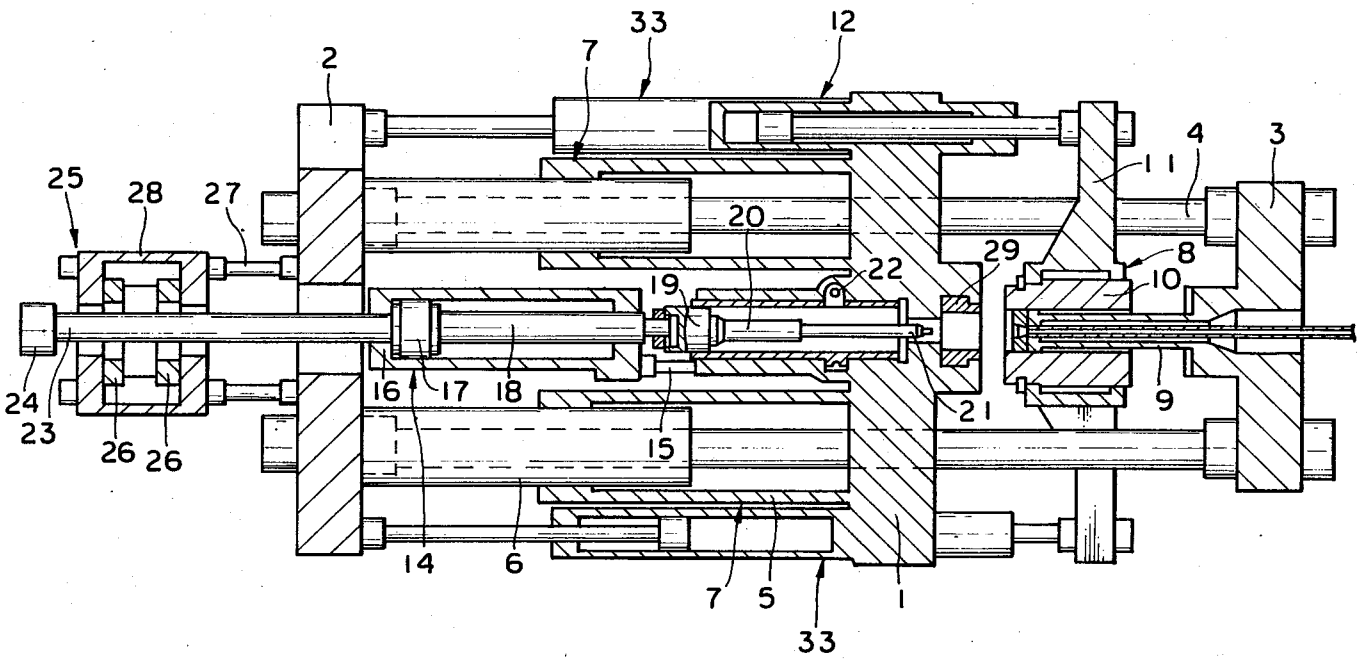
Figure 11:
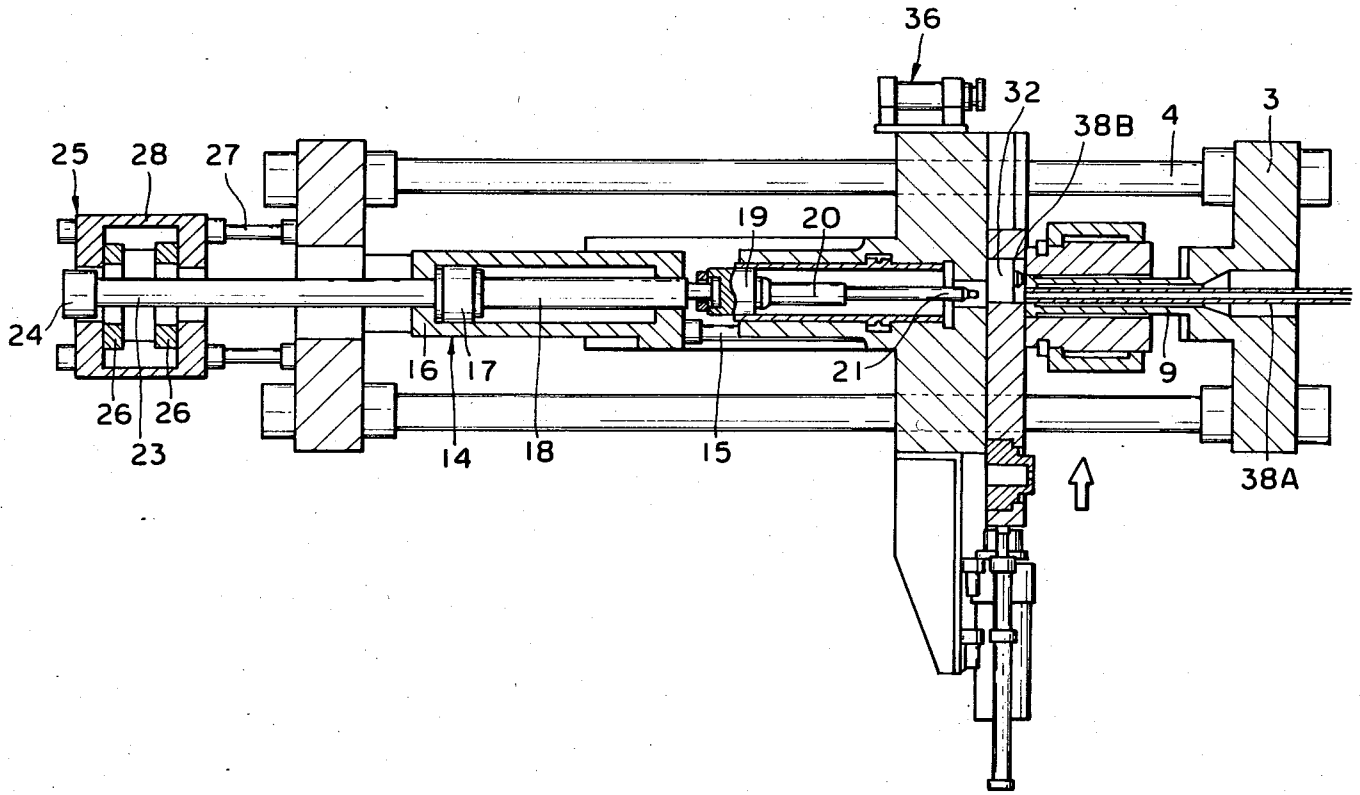
Figure 12:
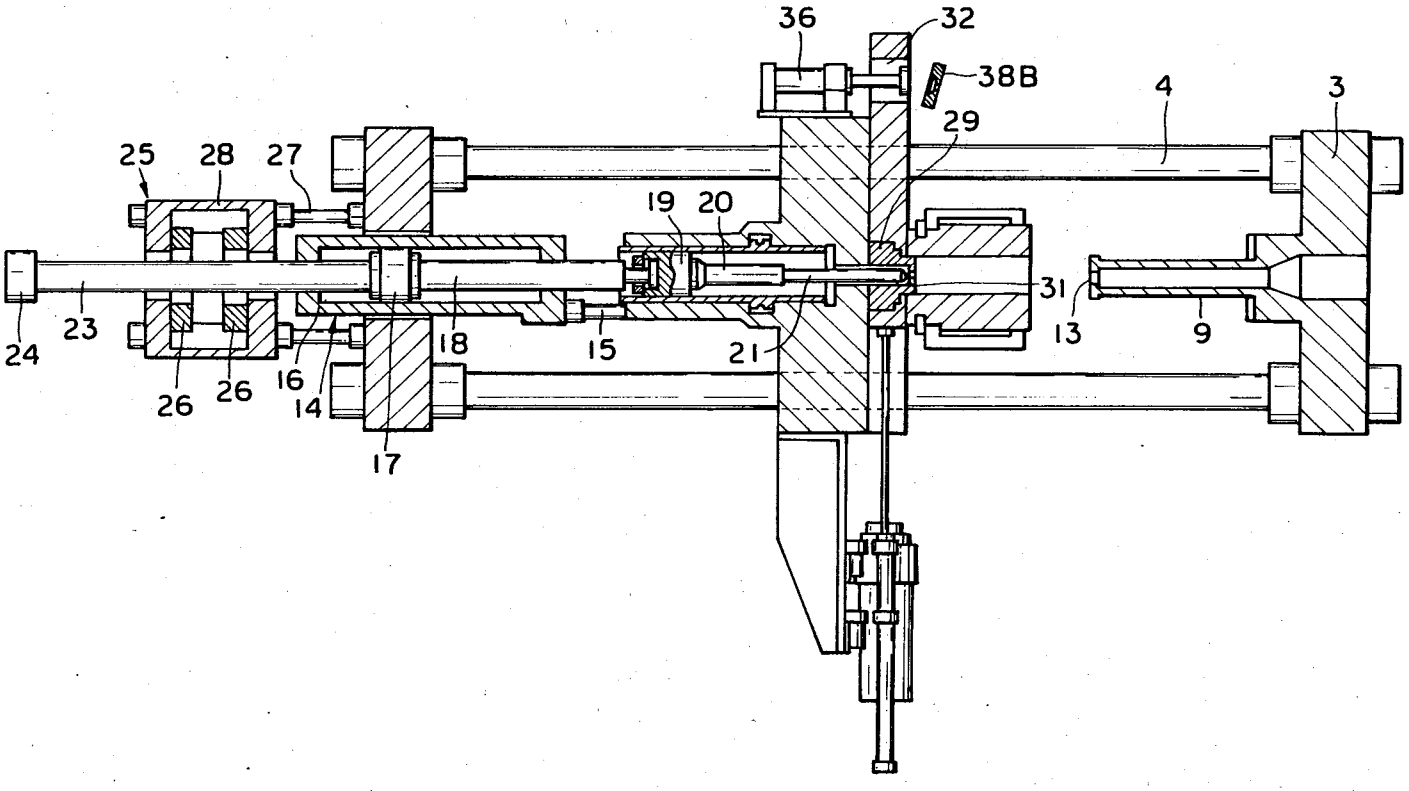
Figure 19:
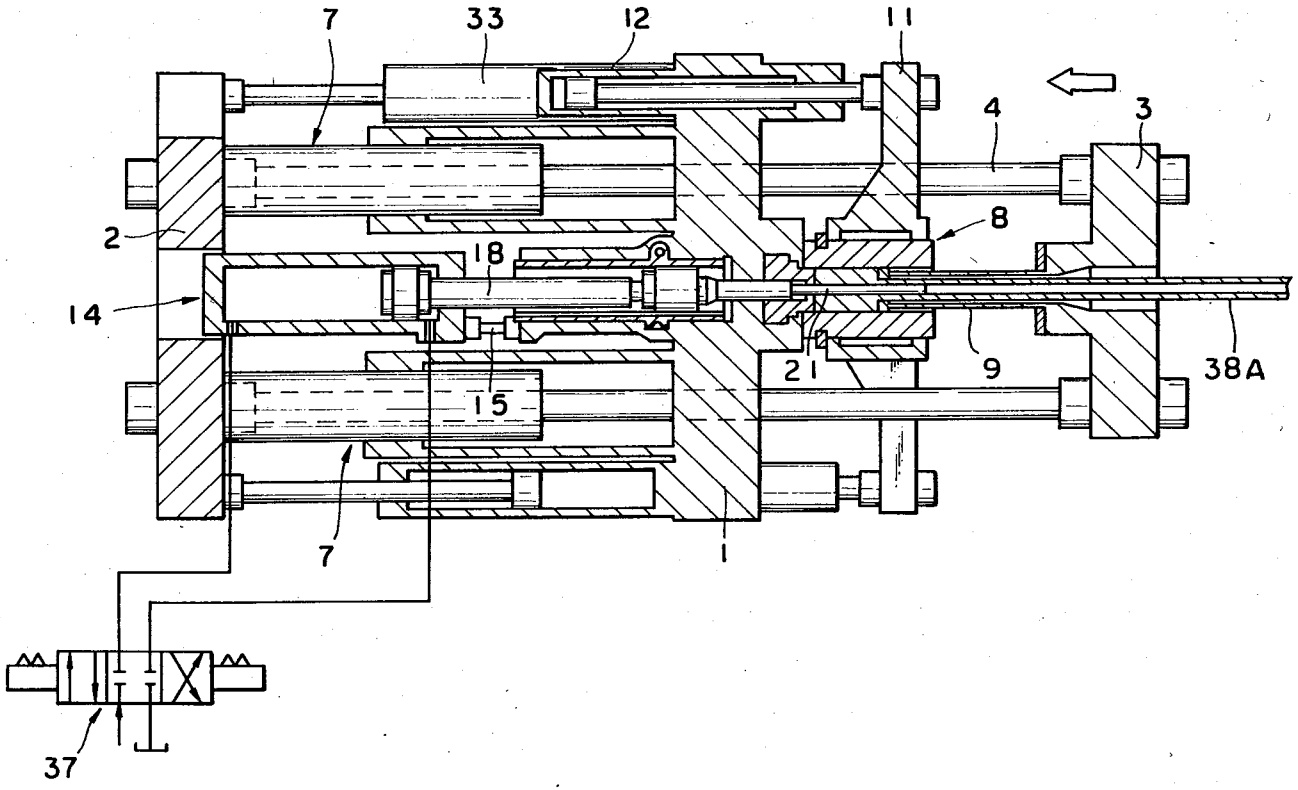

A die slide 29 provided on the fixed platen 1 is slid in a direction normal to the press direction to position an opening 32 formed in the side 29 on the press axis, as shown in FIG. 9. When the container device 8 and the die stem 9 are again moved forward, an extruded refuse 38B is accommodated into the opening 32 as shown in FIG. 19, in which state, the die slide 29 is slide in a direction normal to the press direction thereby cutting the refuse 38B and tubular product 38A as shown in FIG. 11. A seal block 31 is registered with the press axis, and the opening 32 is positioned externally of the press. When a pusher 36 is then extended, the refuse 38B at the opening 32 is ejected to assume an initial position as shown in FIG. 12, thus completing one cycle of the press.

Embodiments of the present invention will now be described. The press in accordance with a first embodiment of the present invention is illustrated in FIGS. 1 and 2.

Figure 1:
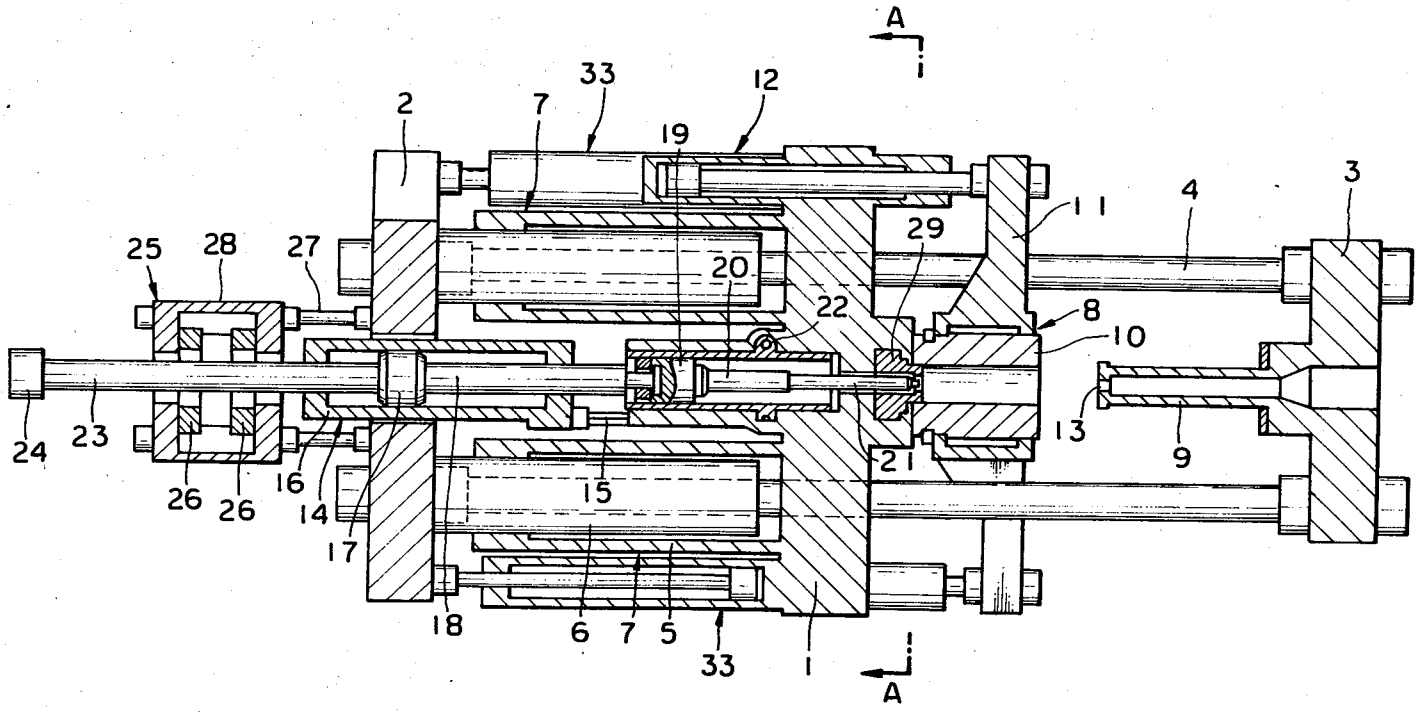
FIG. 1 is a sectional view showing a first embodiment of the press according to the present invention.
Figure 2:
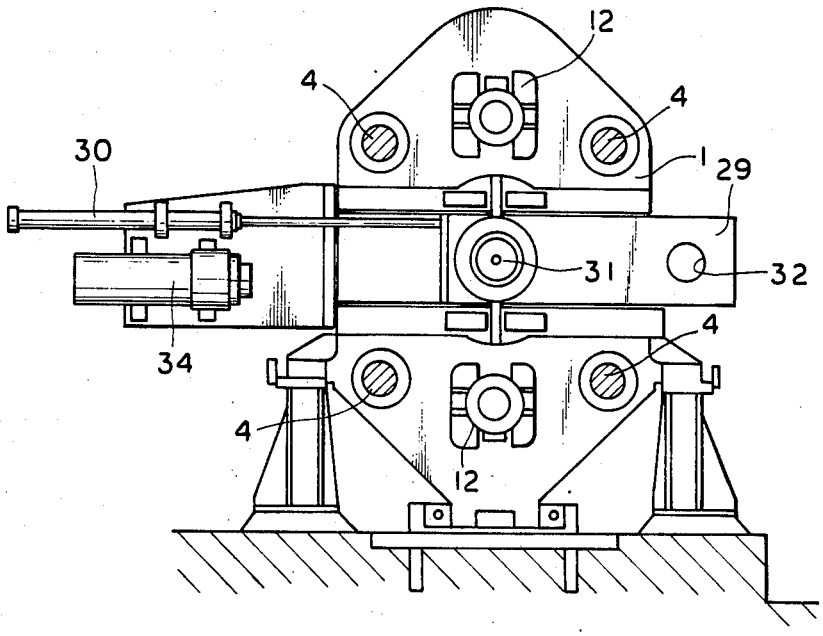
FIG. 2 is a sectional view taken along line A—A of FIG. 1.

In FIG. 1, a pair of movable platens 2 and 3 are opposedly arranged in front of and to the rear of a fixed platen 1. Where the movable platens 2 and 3 are diagonally arranged, they are connected to each other by four columns 4.

A pair of upper and lower means for producing an extruding force 7 comprising a main cylinder 5 and a main ram 6 are provided between the fixed platen 1 and one movable platen 2.

Accordingly, the movable platens 2 and 3 arranged in front of and to the rear of the fixed platen 1 and connected to each other by the columns 4 may be freely moved in a lateral direction (as viewed in the figure) by the producing means 7.

A container device 8 and a die stem 9 are provided between the fixed platen 1 and the other movable platen 5. The container device 8 comprises a container 10 having a billet chamber on the center of the press. a holder 11 for holding the container 10, and the like. The container device may be moved in a lateral direction (in a direction of the press) by the expanding action of a container moving cylinder mechanism 12.

The die stem 9 is in the form of a tube mounted on the movable platen 3, and is formed at the foremost end thereof with a die hole 13 for determining an external configuration of a material to be extruded, the die hole 13 being positioned in the center line of the press.

On the press axis of the side of anti-extrusion zone of the fixed platen 1, that is, on the side of the movable platen 2 there is provided a piercing cylinder mechanism 14 through a reaction withstanding member 15 shown in the form of a tie rod.

The cylinder mechanism 14 is provided with a cylinder tube 16 mounted on the fixed platen 1 through the tie rod 15 and a piston ram 17 fitted into the cylinder tube 16. A piercing piston rod 18 is operatively connected to the piston ram 17, said rod 18 being relatively rotable round a mandrel cross head 19 and be movable in a direction of the press for engagement therewith. The piston rod 18 is mounted on the mandrel 21 through the mandrel holder 20.

The mandrel cross head 19 is retained on a mandrel turning device 22 provided on the side of the fixed platen 1. A tail rod 23 is operatively connected to the piston ram 17 of the piercing mechanism 14, and an engaging portion 24 in the form of a flange is provided on the tail rod 23.

It is to be noted that the engaging portion 24 can be fastened to the tail rod 23 by means of a screw so that the engaging portion 24 may be secured movably lengthwise of the rod 23. Accordingly, when oil under pressure is supplied in the expanding direction of the piercing cylinder mechanism 14, the latter is moved toward the die stem 9 to pierce the billet. When the foremost end of the mandrel 21 faces the die hole 13 of the die stem 9, the relative position between the die hole 13 and the foremost end of the mandrel 21 during extrusion is maintained by engagement of the pair of gate members 26 of the mandrel stopper mechanism 25 with the engaging portion 24.

The mandrel stopper mechanism 25 is provided at the rear of the movable platen 2. In the illustrated embodiment, a stopper frame 28 is mounted on the movable platen 2 through the reaction withstanding member 27 shown in the form of a tie rod, and a pair of front and rear gate members 26, which are rotatable around the axis of the press and slidably movable forward and backward to and from the press axis, are provided on the stopper frame 28, said gate members 26 being engaged with and disengaged from the engaging portion 24.

With respect to the remaining structure in this embodiment, in FIGS. 2 and 3, a die slide 29 is provided on the fixed platen 1 through a cylinder mechanism 30 so that the slide 29 may be moved in a direction normal to the press axis, and a guide portion 1A of the die slide 29 is formed on the fixed platen 1. The die slide 29 is formed with a seal block 31 and an opening 32, the seal block 31 being capable of being fitted to the billet chamber of the container 10, the seal block 31 and the opening 32 being changed in position alternately on the press axis by the cylinder mechanism 30.

A side cylinder mechanism 33 is provided between the fixed platen 1 and the movable platen 2. A refuse shearing mechanism 34 is provided on the fixed platen 1, the shearing mechanism 34 being movable forward and rearward in a direction normal to the press axis. On the side opposite to the refuse shearing mechanism 34 is provided a refuse pusher mechanism 36 operated parallel to the press direction as shown in FIG. 11.

Figure 13:
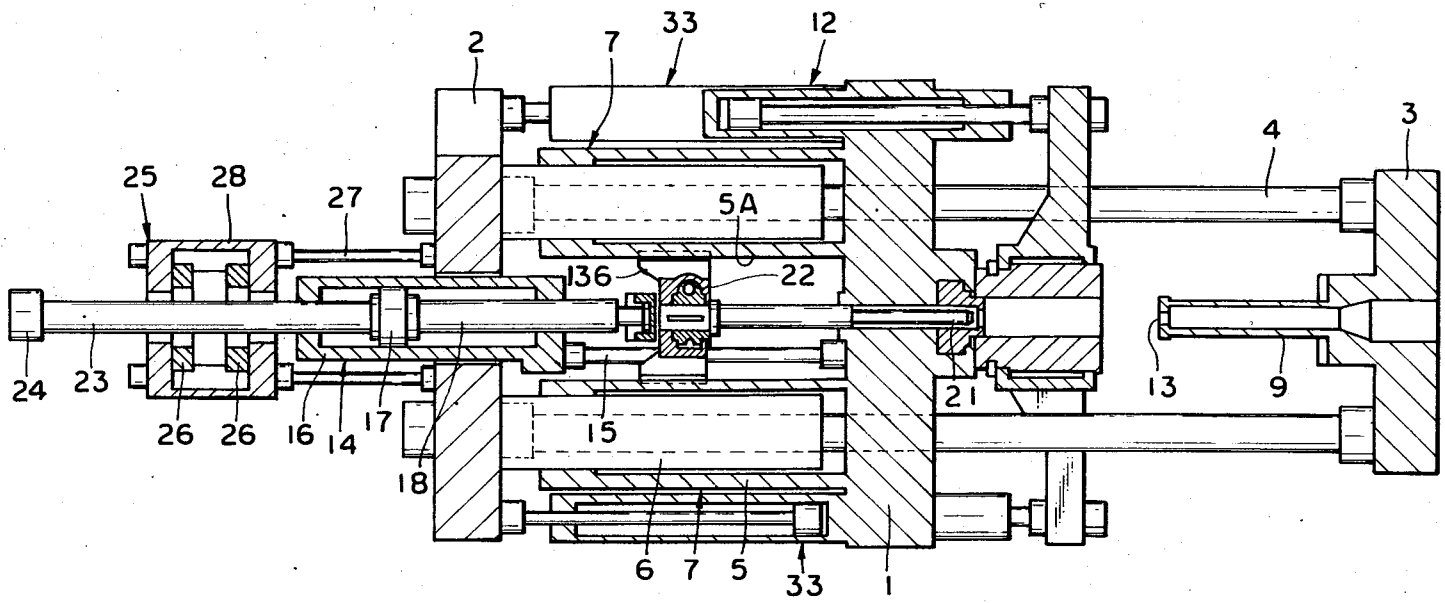
FIG. 13 is a sectional view showing a second embodiment.
Figure 14:
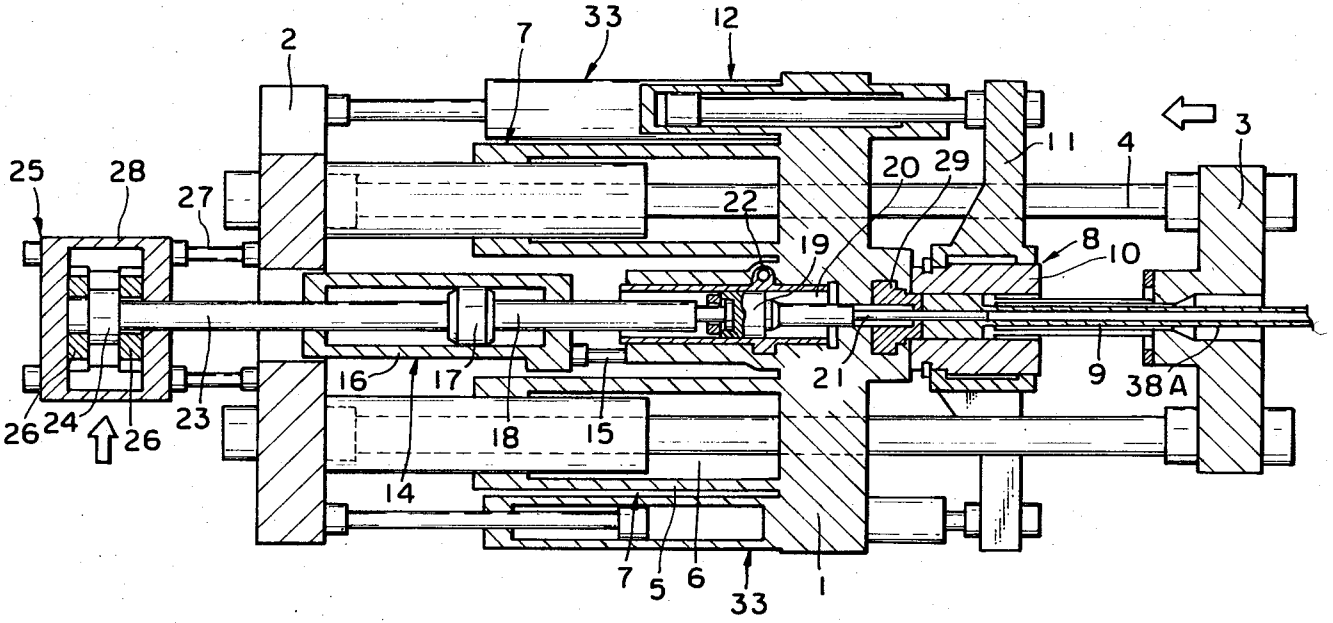
FIG. 14 is a sectional view during extrusion in a fixed mandrel using a straight mandrel.

In a second embodiment shown in FIG. 13, a mandrel turning device 22 is slidably provided with a main cylinder 5 of the means for producing extruding force amount 7 as a guide surface 5A through a holder 136. Other basical structures are common to those shown in the first embodiment described in connection with FIGS. 1 through 12, which common parts are indicated by common reference numerals.

While in the examples shown in FIGS. 1 through 13, a so-called fixed mandrel using a tip mandrel has been shown, it is to be noted that the present invention may be employed even in case of a so-called flowing and extrusion process.

Figure 15:
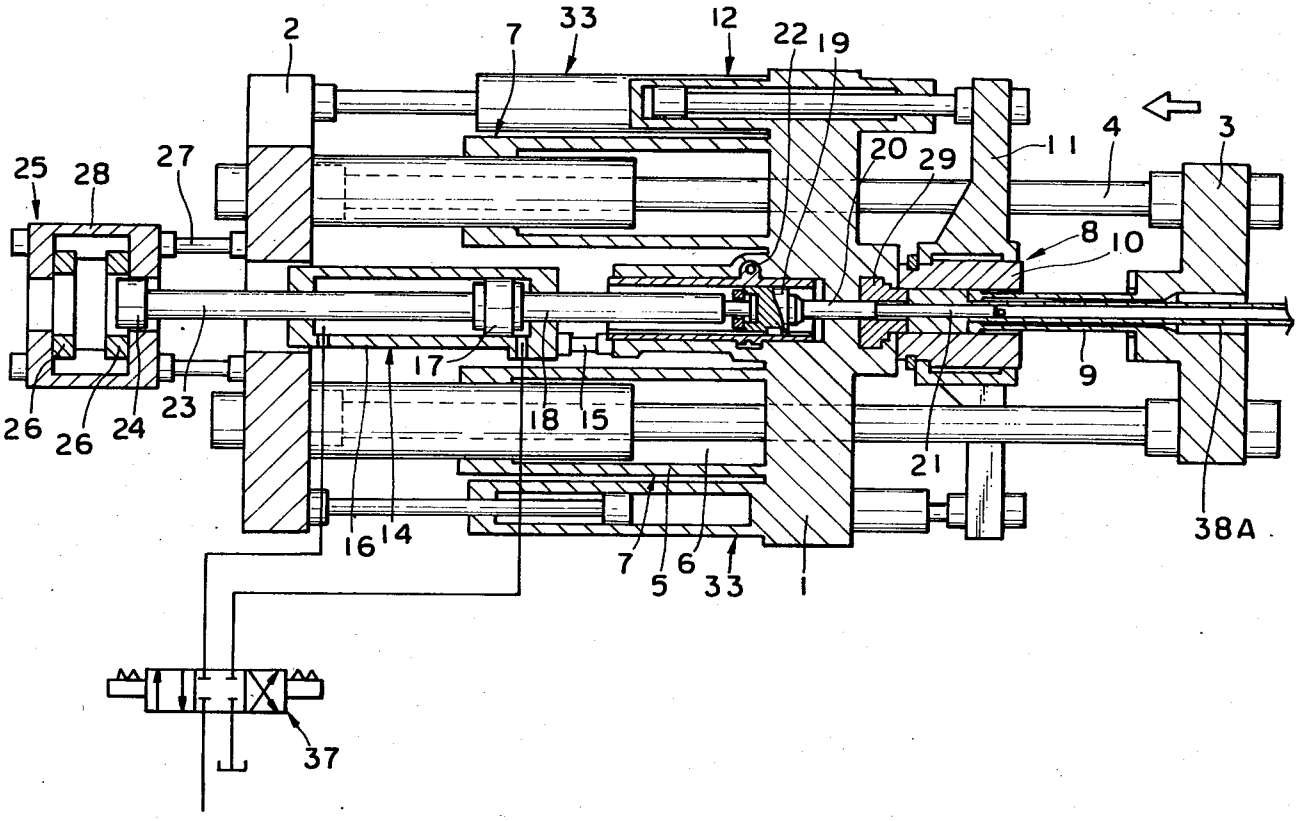
FIG. 15 is a sectional view during extrusion in flowing and extrusion using a straight mandrel.
Figure 16:
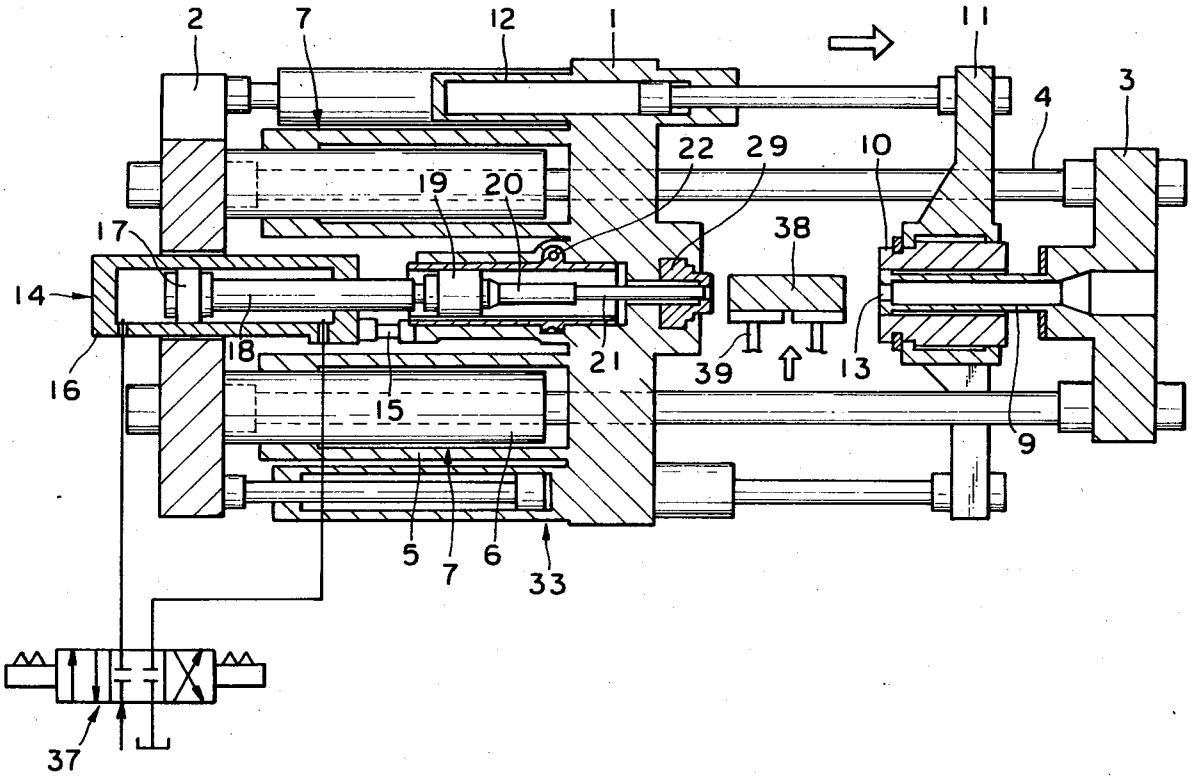
FIGS. 16 through 19 are respectively sectional views showing the steps of supplying a billet, inserting the billet, piercing, and extrusion in said order showing another embodiment of the present invention.
Figure 17:
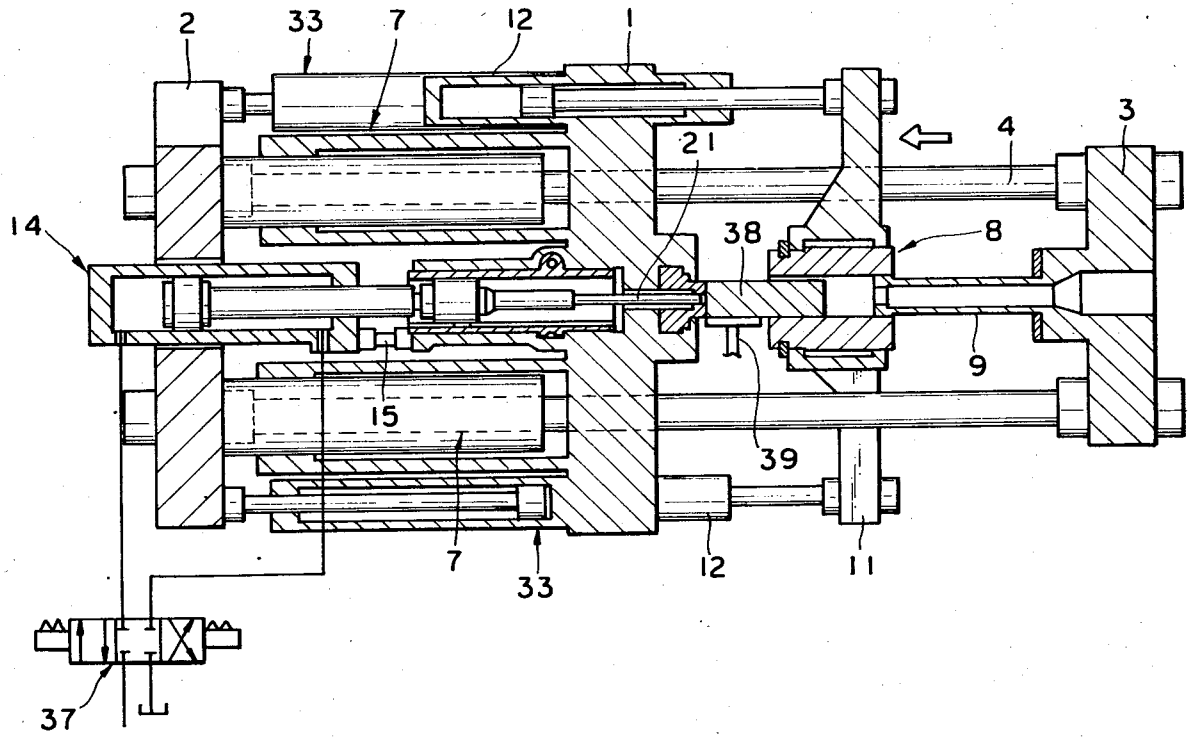
Figure 18:
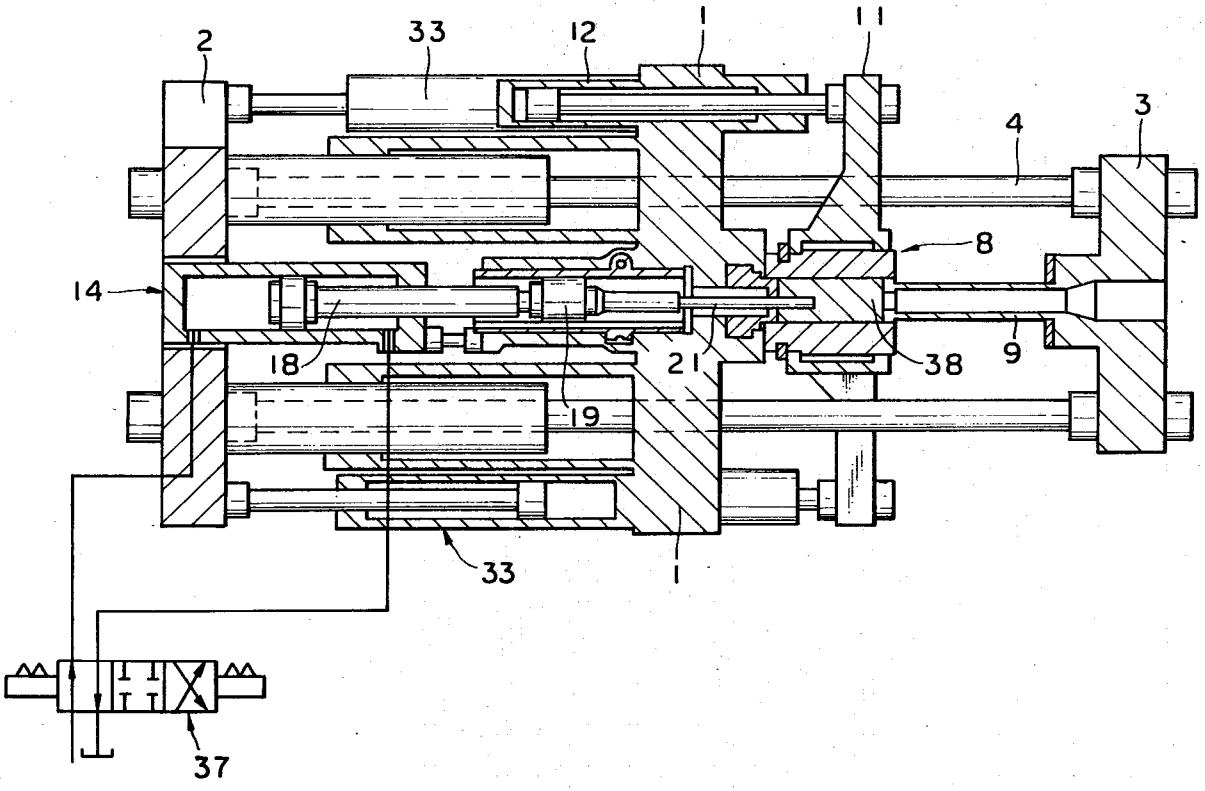

More specifically, oil on the side of advancement of the piercing cylinder is blocked by a feed-liquid switching valve mechanism 37 of the piercing cylinder mechanism 14 as shown in FIG. 15, and extrusion is effected in a state where the gate members 26 are open. That is, according to the present invention, the following extrusions may be accomplished.

(1) Extrusion of a solid billet in the first embodiment shown in FIGS. 3 to 12 by a so-called fixed mandrel using a tipped mandrel can occur by use of the mandrel stopper mechanism 25.

(2) Extrusion of a solid billet by a so-called fixed mandrel using a straight mandrel can be accomplished by use of the mandrel stopper mechanism 25.

(3) So-called flowing and extrusion using a straight mandrel of a solid billet can be utilized by opening the mandrel stopper mechanism 25 and hydraulically blocking the advancing side of the piercing cylinder 16 through the feed-liquid valve mechanism 37.

(4) Extrusion of a hollow billet by a so-called fixed mandrel using a tipped mandrel can be utilized by use of the mandrel stopper mechanism 25.

(5) Extrusion of a hollow billet by a so-called fixed mandrel using a straight mandrel can be accomplished by use of the mandrel stopper mechanism 25.

(6) So-called flowing and extrusion using a straight mandrel of a hollow billet can occur by opening the mandrel stopper mechanism 25 and blocking the advancing side of the piercing cylinder 18.

One cycle of the press in the first embodiment will be once again described with reference to FIGS. 3 through 12.

FIG. 3 illustrates the state where the billet 38 is supplied. When the billet 38 is supplied along the axis of the press by means of the billet loader 39, the billet loader 39 is moved backward outside the press to contract the container moving cylinder mechanism 12 as shown in FIG. 4, whereby the billet 38 is inserted into the container 10.

When the billet 38 is inserted into the container 10, the billet loader 39 is moved backward outside the press to await insertion of the next billet.

Next, the side cylinder mechanism 33 is contracted as shown in FIG. 5, whereby the movable press platens 2 and 3 are moved leftward, and the die stem 9 is brought into abutment with the billet 38 in the container 10 under the non-loaded state and the billet 38 is upset.

Subsequently, the process proceeds to the piercing step as shown in FIG. 6. In this step, oil is fed to the piercing cylinder 16 through the switching operation of the valve mechanism 37 to thereby move the mandrel 21 forward to pierce the billet 38 in the container 10.

Upon termination of piercing of the billet 38 by the mandrel 21, the foremost end of the mandrel 21 faces the die hole 13, where a cross sectional shape of the material to be extruded is set, which state is maintained during extrusion. More specifically, according to the first embodiment, the aforesaid state is maintained by engagement of the gate member 26 provided in front of and rearward of the mandrel stopper mechanism 25 with the engaging portion 24 of the tail rod 23 shown in FIG. 7, whilst in the second embodiment shown in FIG. 15, the aforesaid state is maintained by blocking the piercing cylinder 16 as shown by means of the switching valve mechanism 37. Now the extrusion is ready, and under this state, oil is fed to the producing means 7 to move the movable platens 2 and 3 and the die stem 9 provided thereon leftward as indicated by the arrow in FIG. 7, whereby the billet 38 in the container 10 one end of which is sealed by the seal block 31 is fabricated as a tubular article 38A by the die stem 9 by way of the indirect extrusion.

In this case, in the first embodiment, the mandrel stopper mechanism 25 is mounted on the movable platen 2 and the gate member 26 of the stopper mechanism 37 is in engagement with the engaging portion 24 of the tail rod 23. Therefore the mandrel 21 is moved along with the movable platens 2 and 3, and the relative position between the mandrel 21 and the die hole 13 is maintained during extrusion.

In the case of the embodiment shown in FIG. 15, the circuit on the advancing side of the piercing cylinder mechanism 14 is blocked, and the gate member 26 of the mandrel stopper mechanism 25 is opened, whereby a tubular article 38A may be fabricated by so-called flowing and extrusion by way of indirect extrusion.

Upon completion of extrusion, the gate member 26 is opened as shown in FIG. 8, and the main ram 6 and the container 10 are slightly moved backward as shown in FIG. 8 to transfer the refuse 38B into the container 10, after which the die slide 29 is slidably moved by the cylinder mechanism 30 in a direction normal to the press to coincide with the opening 32 formed in the slide 29 with the center of the press.

Figure 10:
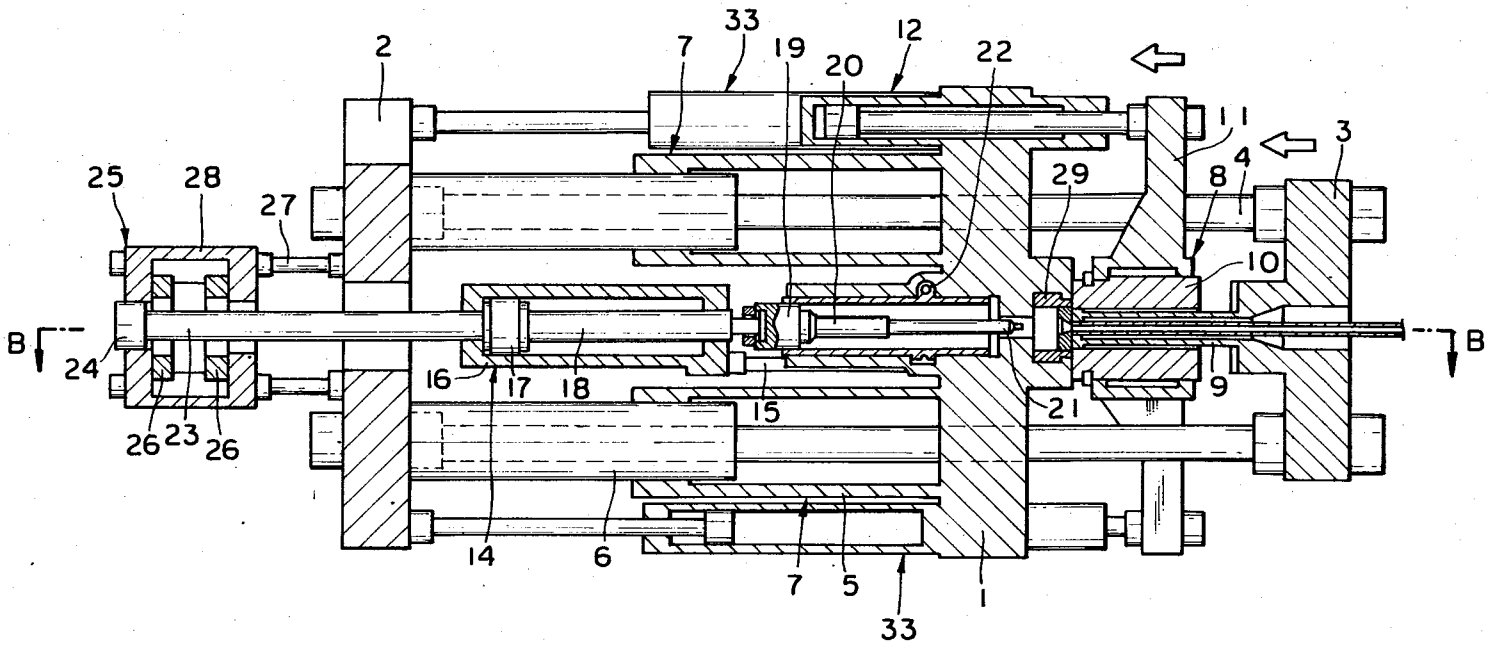

In this state, the container device 8 and the die stem 9 are moved as shown in FIG. 10 to transfer the refuse 38B into the opening 32, after which the shearing mechanism 34 is expanded thereby cutting the refuse 38B from the article 38A as shown in FIG. 11. The refuse 38B is moved externally of the press as shown in FIG. 12 while being received in the opening 32, and the pusher 36 is expanded to eject the refuse 38B as shown and the seal block 31 is placed in registration with the center of the press to assume an initial position.

FIGS. 16 through 19 show another embodiment of the present invention showing the steps of supplying a billet (FIG. 16), inserting the billet (FIG. 17), piercing (FIG. 18) and extrusion (FIG. 19), which embodiment is different from the previously mentioned embodiments merely in that the mandrel stopper mechanism 25 is omitted, and other elements of this embodiment are the same as those of the previous embodiments and therefore, common elements are indicated by common reference numerals.

In the examples shown in FIGS. 16 through 19, flowing and extrusion can occur by locking the liquid switching valve mechanism 37 as shown in FIG. 19.

Figure 20:
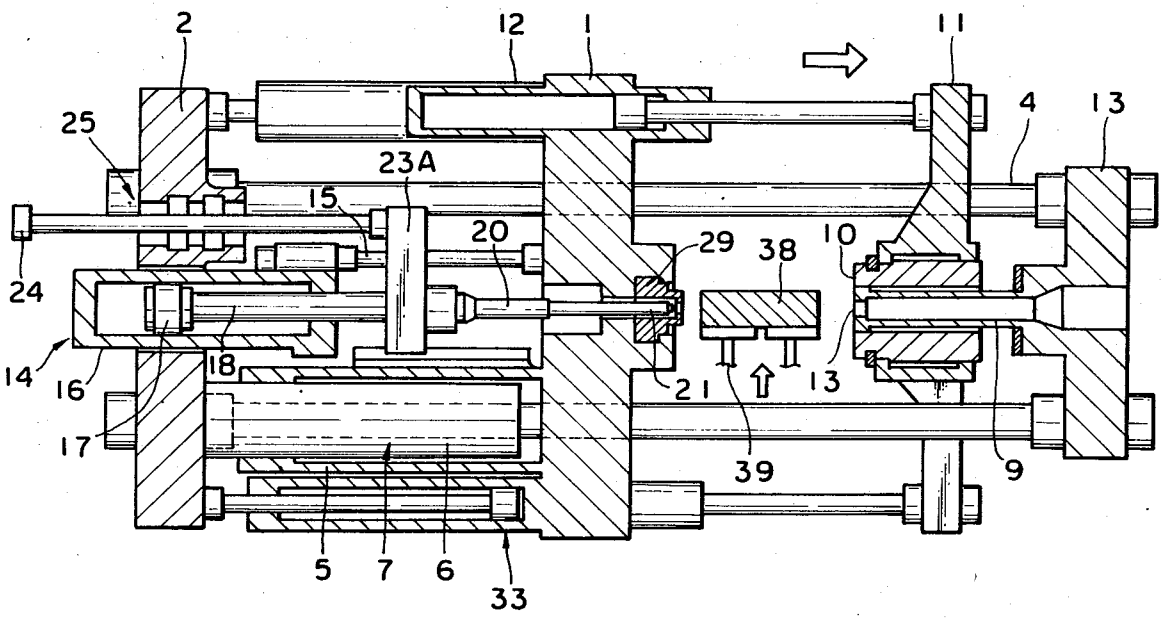
FIGS. 20 through 24 are respectively sectional views of another embodiment of the present invention having a side stopper mechanism showing the steps of supplying a billet, inserting the billet, upsetting, piercing and extrusion in said order.
Figure 21:
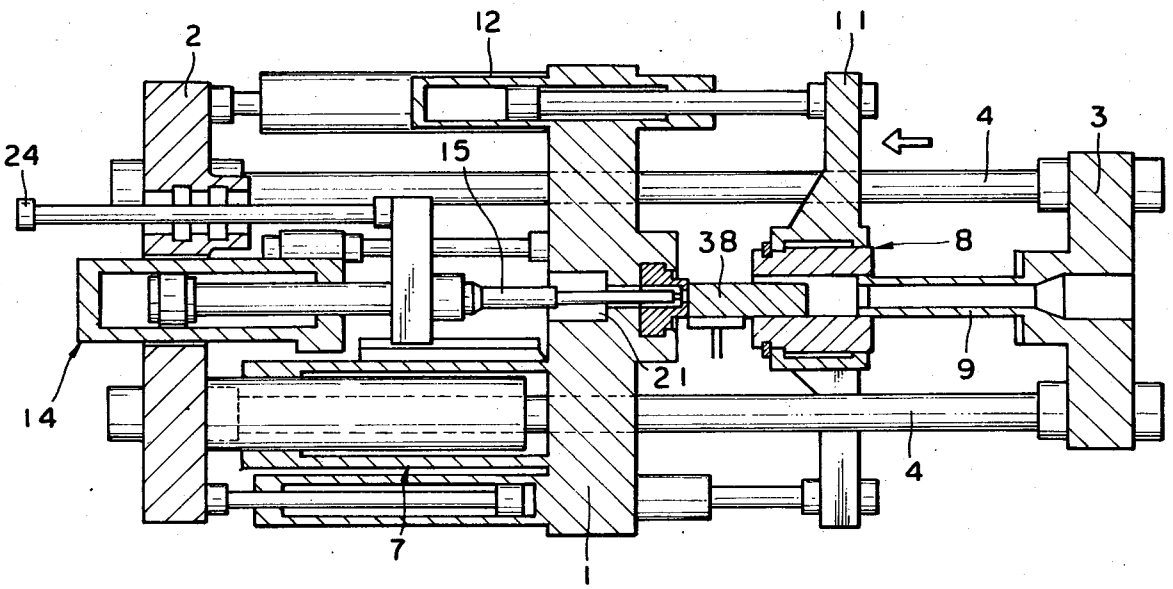
Figure 22:
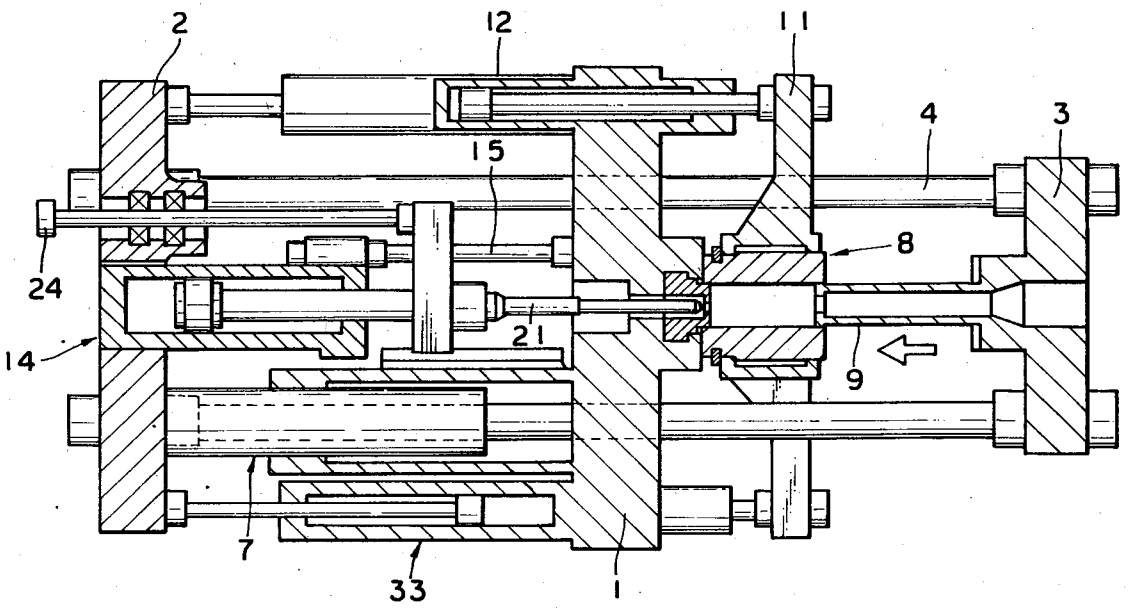
Figure 23:
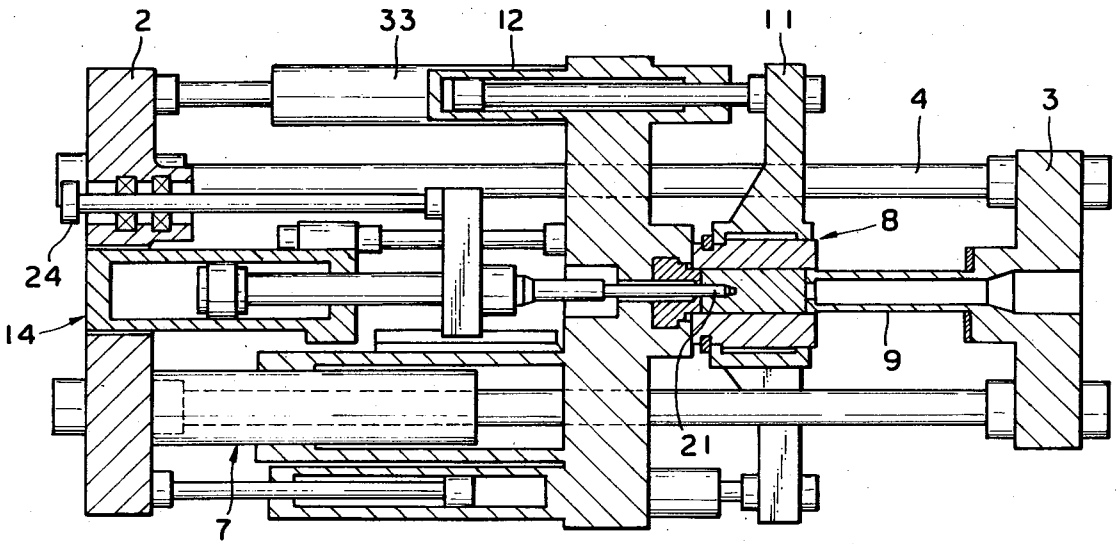
Figure 24:
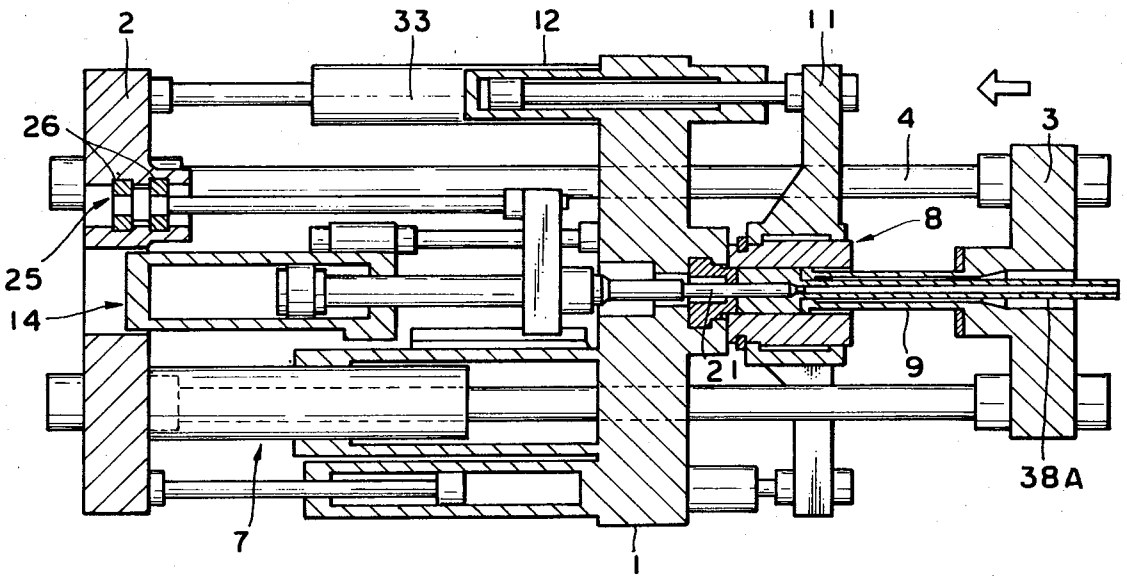

FIGS. 20 through 24 illustrate the side stopper construction as the mandrel stopper mechanism 25. A lockin rod 23 having an engaging portion 24, that is, the aforementioned tail rod, is engaged with or disengaged from the movable platen 2 through a cross head 23A. FIG. 20 shows the step of supplying a billet, FIG. 21 shows insertion of a billet, FIG. 22 shows upsetting, FIG. 23 shows piercing, and FIG. 24 shows extrusion. Other common parts are indicated by common reference numerals.

Figure 25:
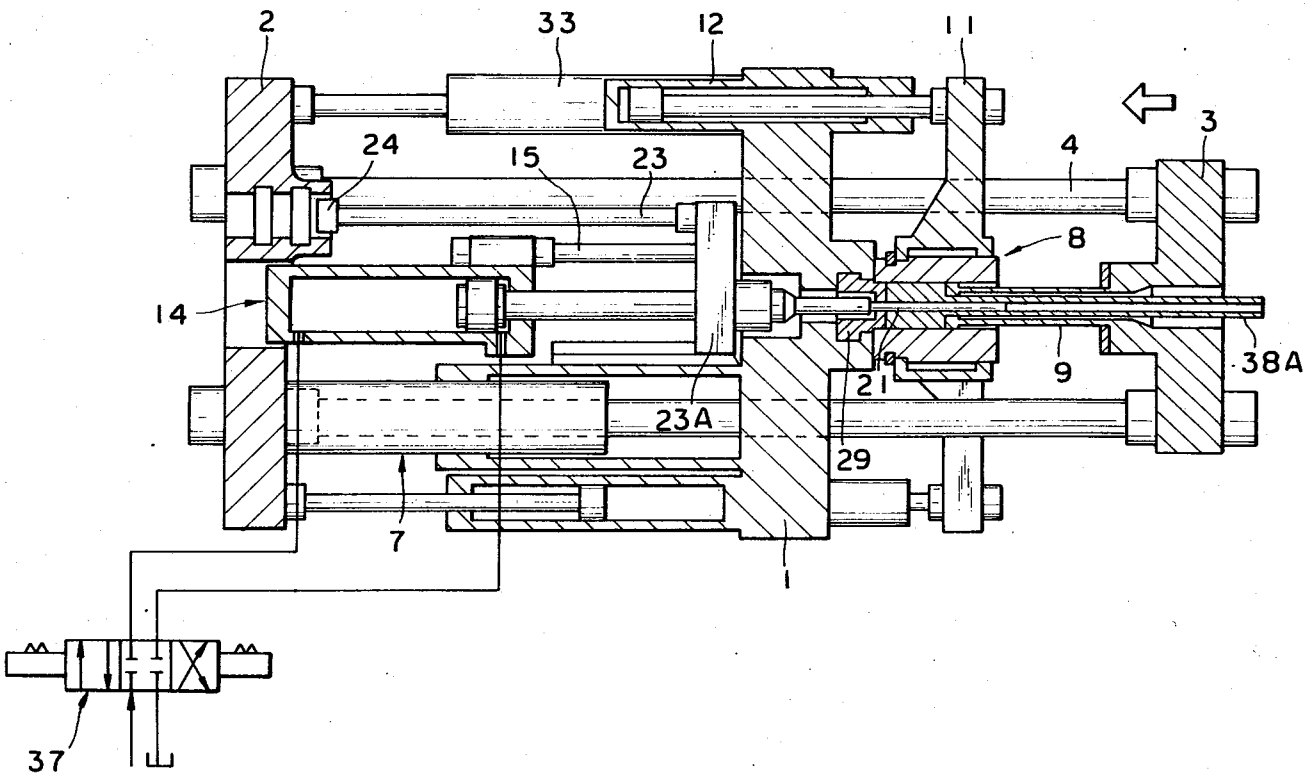
FIG. 25 is a sectional view during extrusion when flowing and extrusion take place by means of an extrusion press shown in FIGS. 20 through 24 having a side stopper mechanism.

FIG. 25 is different in construction from FIGS. 20 through 24 in that flowing and extrusion can be made by the press shown therein.

Since the pullback type indirect extrusion press according to the present invention, the piercing mechanism 14 is provided along the press axis on the side of non-extrusion zone, it is possible to extrusion-mold a pipe member with high quality and high precision.

Furthermore, since the piercing cylinder mechanism 14 is independent of the means for producing extrusion force amount, the construction as a whole is simplified, maintenance is simple and a reliability of the equipment is high. Moreover, the piercing cylinder mechanism 14 may be reciprocatingly locked by the feed-liquid switching valve mechanism 37, and flowing and extrusion may be switched.

Obviously, numerous modifications and variations of the present invention are possible in light of the above teachings. It is therefore to be understood that within the scope of the appended claims, the invention may be practiced otherwise than as specifically described herein.

What is claimed is:

1. A pullback type indirect extrusion press, comprising:

a fixed platen having an opening formed therein for allowing for piercing of a billet;

first and second movable platens rigidly connected to each other, said first and second movable platens, respectively, being arranged in front of and behind said fixed platen;

means connected to said first movable platen and said fixed platen for producing an extruding force provided between said fixed platen and said first movable platen;

a container device connected to said fixed platen and a die stem connected to said second movable platen arranged between said fixed platen and said second movable platen;

a piercing cylinder mechanism mounted on said fixed platen and positioned between said fixed platen and said first movable platen, and provided independent of said means for producing an extruding force, wherein said piercing cylinder mechanism further comprises a mandrel extending through said opening and cooperating with a die hole of the die stem to determine a shape of a material to be extruded in an extruding direction;

a feed-liquid switching valve mechanism for reciprocatingly sliding the mandrel along the axis of the press; and a mandrel stopper mechanism positioned on a side of said first movable platen opposite said piercing cylinder mechanism and having a gate member engageable and disengageable with an engaging portion of the piercing mechanism extending through an opening in said first movable platen.

2. A pullback type indirect extrusion press, comprising:

a fixed platen having an opening formed therein for allowing for piercing of a billet;

first and second movable platens connected to each other, said first and second movable platens, respectively, being arranged in front of and behind said fixed platen, means connected to said first movable platen and said fixed platen for producing an extruding force between said fixed platen and said first movable platen;

a container device connected to said fixed platen and a die stem connected to said second movable platen arranged between said fixed platen and said second movable platen;

a piercing cylinder mechanism mounted on said fixed platen between said fixed platen and said first movable platen, independent of said means for producing an extruding force, wherein said piercing cylinder mechanism comprises a mandrel extending through said opening and cooperating with a die hole of said die stem to determine a shape of a material to be extruded in an extruding direction side of said fixed platen and a tail rod connected to said mandrel and having an engaging portion on said nonextruding direction side of said fixed platen so that the mandrel may reciprocatingly slide and a feed-liquid switching valve mechanism connected to said piercing cylinder mechanism for locking said mandrel along said press axis; and a mandrel stopper mechanism positioned on a side of said first movable platen opposite said piercing cylinder mechanism and having a gate member engageable and disengageable with said engaging portion of the piercing mechanism.

3. A pullback type indirect extrusion press as defined in claim 2 wherein said press further comprises a flowing and extrusion mechanism in which said gate member is opened, and a feed-liquid valve mechanism for blocking oil on an advancing side of the piercing cylinder mechanism.

* * * * *